US007445426B1

(12) United States Patent
Matheny et al.

(10) Patent No.: US 7,445,426 B1
(45) Date of Patent: Nov. 4, 2008

(54) GUIDE VANE OUTER SHROUD BIAS ARRANGEMENT

(75) Inventors: Alfred P. Matheny, Jupiter, FL (US); John N. Keune, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 498 days.

(21) Appl. No.: 11/255,129

(22) Filed: Oct. 20, 2005

Related U.S. Application Data

(60) Provisional application No. 60/690,853, filed on Jun. 15, 2005.

(51) Int. Cl.
*F01D 9/00* (2006.01)

(52) U.S. Cl. ..... 415/135; 415/138; 415/193; 415/194; 415/209.1; 415/209.2

(58) Field of Classification Search ..... 415/146, 415/155, 191, 193, 194, 199.5, 209.1, 209.2, 415/209.3, 209.4, 210.1, 211.2, 135, 138; 277/359, 360, 379, 433
See application file for complete search history.

(56) References Cited

U.S. PATENT DOCUMENTS 2,724,546 A * 11/1955 Barrett, Jr. et al. ..... 415/209.1
3,146,938 A * 9/1964 Smith ..... 415/173.7
3,326,523 A * 6/1967 Bobo ..... 415/209.3
3,937,592 A * 2/1976 Bammert ..... 415/194
4,897,021 A 1/1990 Chaplin et al.
5,846,050 A 12/1998 Schilling
6,062,813 A 5/2000 Halliwell et al.
6,296,443 B1 10/2001 Newman et al.
6,568,903 B1 5/2003 Aksit et al.
6,752,592 B2 6/2004 Mohammed-Fakir et al.

* cited by examiner

*Primary Examiner*—Edward Look
*Assistant Examiner*—Aaron R Eastman
(74) *Attorney, Agent, or Firm*—John Ryznie

(57) ABSTRACT

A compressor includes a stator having a plurality of vane sectors each with an outer shroud having a forward and a rearward guide vane extending there form, the vane sector being mounted in an annular slot of the casing, the guide vanes forming a gap between the tips and an inner shroud, and a spring member located on the outer shroud in the rearward portion to bias the rearward shroud in a radial direction, where a space is formed in the slot to allow for the outer shroud to move in the radial direction when the rearward guide vane tip makes contact with the inner shroud due to thermal growth of the stator components. This arrangement allows for the rearward guide vane tip to maintain contact with the inner shroud without inducing high compressive stresses in the stator components due to the thermal growth.

11 Claims, 3 Drawing Sheets

GUIDE VANE OUTER SHROUD BIAS ARRANGEMENT

CROSS-REFERENCE TO RELATED APPLICATIONS

This Regular application claims the benefit to an earlier filed U.S. Provisional Application No. 60/690,853 filed on Jun. 15, 2005 and entitled Guide Vane Outer Shroud Bias Arrangement.

BACKGROUND OF THE INVENTION

1. Field of the Invention

The present invention relates to a guide vane assembly used in a last stage of a compressor having multiple stages.

2. Description of the Related Art Including Information Disclosed Under 37 CFR 1.97 and 1.98

Gas turbine engines include stationary guide vanes 12 and 16 (FIG. 1) located upstream of the rotary blades, the guide vanes redirect the gas stream flow in a most effective direction to act on the rotating blade. Each guide vane 12 and 16 include an outer shroud segment 10 and 14, in which the vanes are secured, and an inner shroud 18 that provides a gap (13,17) between a tip of the guide vane and the shroud. If this gap (13,17) is large, a large portion of the gas stream will flow through the gap and bypass the rotary blades, therefore decreasing the efficiency of the gas turbine engine. The gap decreases due to thermal loads on the shrouds and vanes.

A compressor in a gas turbine engine includes a plurality of stages followed by a diffuser. It is desirable for the compressed air flow leaving the last stage of the compressor to enter the diffuser without any flow separation. It is desirable to have a smooth air flow passing into the diffuser in order to maximize the benefit of the diffuser. One guide vane can be used for the last stage of the compressor to guide the flow into the diffuser, but the air flow is not smooth enough. Using a double guide vane assembly in which two guide vanes are arranged in series will smooth out the air flow from the compressor to prevent flow separation. However, it is difficult to design this type of guide vane assembly with respect to the gap between vane tips and inner shrouds to minimize the air gap with changes in gap spacing due to thermal growth due to high temperatures in the compressor.

Prior attempts to improve on this loss due to a large gap is to secure both guide vanes 22 and 24 to a common outer shroud segment 20, and secure the inner shroud 26 to the guide vane tips to create a gap-less flow path through the vanes (FIG. 2). However, this attempt proved to be difficult to tune the guide vane assembly, and difficult to meet the structural criteria.

The inventors of the present invention has discovered that the tandem guide vanes can be secured to a common outer shroud segment while each guide vane tip maintains a gap between the respective tip and the inner shroud, while also providing for a spring bias member acting on the outer shroud at a location downstream from the two vanes and in a direction radially inward.

BRIEF SUMMARY OF THE INVENTION

In a compressor section of a gas turbine engine, a tandem assembly of two guide vanes each secured to an outer shroud segment and each vane defining a gap between the respective tip and the inner shroud segment, where a spring bias member acts on the outer shroud to move the outer shroud radially inward to close the gap between the rear-most vane tip and the inner shroud. Several embodiments of the spring bias are disclosed. As the gap decreases during engine use, such as from thermal growth of the assembly, the vane tip will make contact with the inner shroud surface. Additional radial growth of the vane will cause the outer shroud rear portion to compress the spring bias member. The outer shroud assembly provides a pivot-like action, and the spring bias member acts to provide a pivot in the radial inward direction. Contact of the vane tip and the inner shroud will pivot the shroud assembly in the opposite direction, with the spring bias member providing a restoring force.

DETAILED DESCRIPTION OF THE INVENTION

Figure 1:
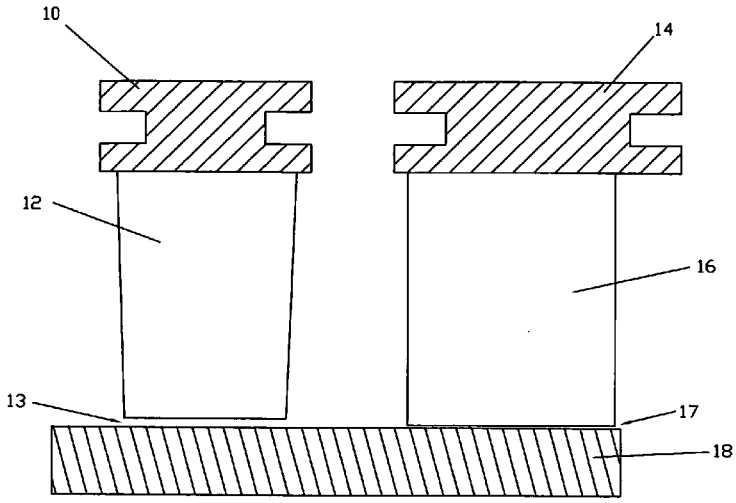
Fig 1 prior art
FIG. 1 show a tandem arrangement of guide vanes where each guide vane is secured to a separate outer shroud segment.
Figure 2:
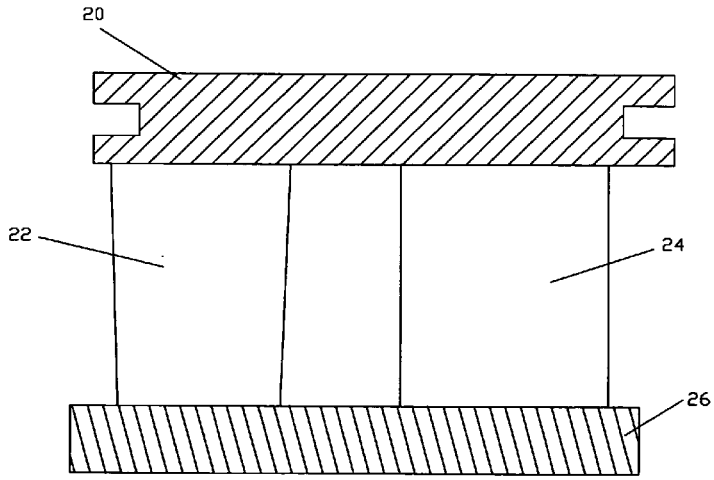
Fig 2 prior art
FIG. 2 shows the tandem arrangement of guide vanes, where both guide vanes are attached to a common outer shroud segment.

A gas turbine engine includes a compressor having tandem guide vanes 34 and 36 (seen in FIG. 3) located upstream in the gas path to a diffuser. The forward guide vane 34 and rearward guide vane 36 are secured to a common outer shroud segment 32, and extend inward toward an inner shroud segment 38. A forward gap 35 is formed between the forward vane tip and the inner shroud 36, and a rear gap 37 is formed between the rear vane 36 and the inner shroud segment 38. The outer shroud segment 32 is mounted within a slot 31 of the compressor casing 30. The slot 31 has a cross-sectional shape such that the outer shroud segment 32 fits tightly in the front portion of the slot 31, but fits loosely in the rear portion of the slot 31. The loose fit in the rear portion of the slot 31 will allow for the outer shroud segment 32 to move radially outward. A spring bias member is mounted in the outer shroud segment 32 to force the outer shroud segment 32 in a radial inward direction.

Forward guide vane 34 forms a gap 35 between the tip and the inner shroud 38, while rearward guide vane 36 forms a gap 37 between the tip and the inner shroud 38. The rear gap 37 of the tandem assembly is smaller than the forward gap 35. A spring bias member is mounted in the outer shroud segment in the rear portion, and the spring bias member acts to move the outer shroud segment in the radial inward direction to close the vane tip gap.

When the compressor is operating, the rear gap 37 can be eliminated due to thermal growth of the vane and shrouds. As the rear gap 37 decreases to zero, the rear vane 36 tip will make contact with the inner shroud 38. If this thermal growth increases after the contact has been made, the outer shroud segment 32 will move upward against the spring bias member force, and the rear slot space (formed between the slot 31 and the outer shroud segment 32) will decrease. Thus, the rear vane gap 37 will remain zero and the gas stream will not bypass the vane. Maintaining a zero gap space 37 at the downstream vane 36 will prevent separation of the air flow and promote a smooth airflow into the diffuser. Compressor and engine efficiency is increased by this.

Figure 4A:
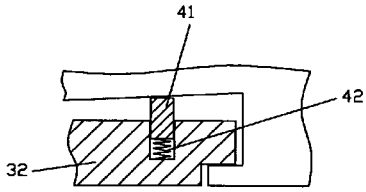
FIGS. 4*a* through 4*d* show various embodiments of the spring bias member used in the present invention.
Figure 4C:
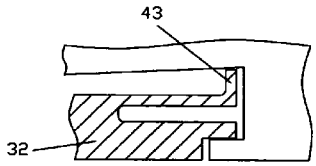
Figure 4B:
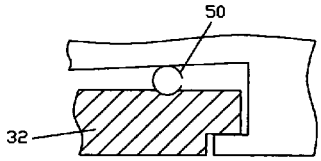
Figure 4D:
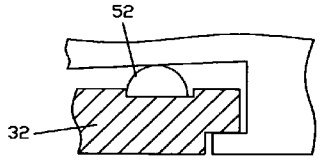

FIGS. 4*a* through 4*d* show various embodiments of the spring bias member mounted to the outer shroud segment 32. FIG. 4*a* shows a slot formed in the outer shroud segment 32, and a pin member 41 movable within the slot. A spring member biases the pin member 41 upward to make contact with the surface of the slot 31 in the casing 30. FIG. 4*b* shows a C-shaped spring 50 pinched between a slot formed on the outer shroud segment 32 and an inner surface of the slot 31. The C-shaped spring 50 will also provide a bias force between the slot 31 and the outer shroud segment 32. FIG. 4*c* shows a cutout formed in the outer shroud segment to form a finger member 43 on the outer shroud segment 32. The finger 43 acts as a spring to bias the outer shroud 32 against the contact surface of the slot 31. FIG. 4*d* shows a slot 53 formed in the outer shroud segment 32 having a spring member 52 placed between slot 53 and the inner surface of slot 31.

Figure 3:
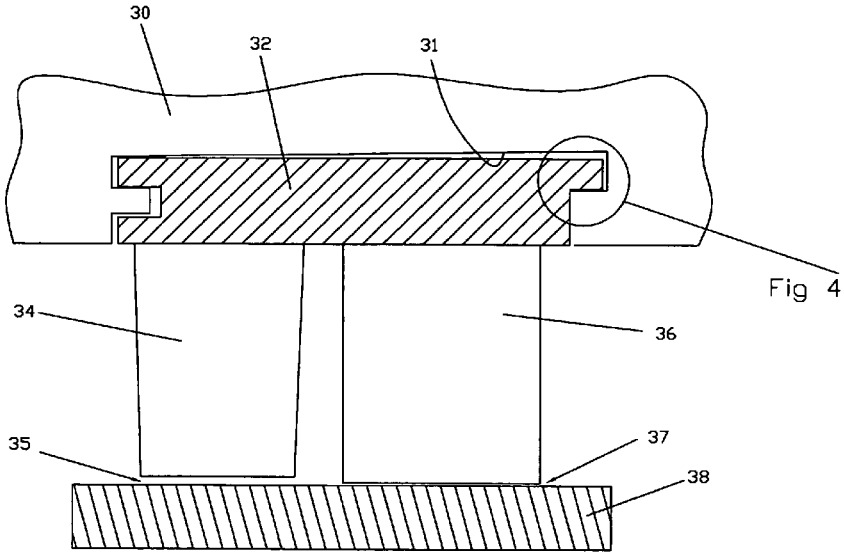
FIG. 3 shows the present invention, in which tandem guide vanes are secured to a common outer shroud segment, and a bias spring member is located on a rear portion of the outer shroud segment.
Figure 5:
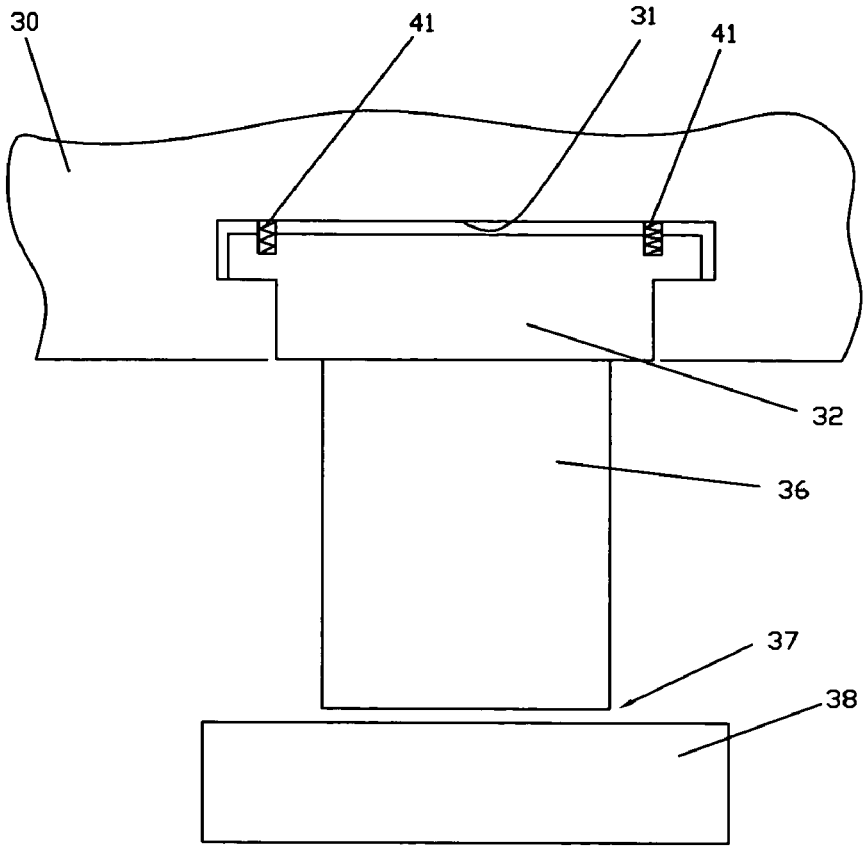
FIG. 5 shows an additional embodiment of the present invention for use with a single guide vane.

FIG. 5 shows a guide vane assembly having a single vane 36 as opposed to the serial guide vane arrangement in FIG. 3. In this embodiment, two springs 41 in the outer shroud 32 are used instead of a single spring at the downstream side of the vane 36. In the FIG. 3 embodiment, rocking (rotating of the vane in a clockwise direction about a point normal to the drawing in FIG. 3) of the guide vane assembly 36 will not cause much difference in the gap 37 between the vane tip and the inner shroud 38. The gap space 37 at the leading edge of the tip and the gap space 37 at the trailing edge of the tip will be about the same distance. However, in the single vane assembly of FIG. 5 rocking of the vane 37 will cause the trailing edge tip to contact the inner shroud 38 while the leading edge tip will be spaced from the inner shroud 38. Therefore, two springs 41 are needed, one in the upstream end of the vane and one in the downstream end of the vane to allow for the gap to decrease to zero without causing the vane to rock or twist within the slot 31. In the FIG. 5 embodiment, the spring 41 is shown as a spring biased pin as in the FIG. 4*a* embodiment. However, the spring could be any of the embodiments shown in FIGS. 4*a* through 4*d*.

We claim:

1. A compressor stator comprising:

a casing having a circumferential slot for mounting a plurality of vane sectors;

a vane sector having an outer shroud with a means to hold the forward section of the outer shroud to a forward section of the slot, and a means to hold the rearward section of the outer shroud to a rearward section of the slot;

the vane sector comprising a forward guide vane and a rearward guide vane extending from the outer shroud;

an inner shroud forming a gap between a tip of the forward guide vane and a gap between a tip of the rearward guide vane;

the slot including a space to allow for the outer shroud to move radially when the rearward guide vane tip contacts the inner shroud due to thermal growth of the stator; and, a spring means located substantially in the rearward section of the slot and outer shroud to bias the rearward guide vane toward the inner shroud and allow the space between the slot of the outer shroud to shrink when the rearward guide vane tip contacts the inner shroud.

2. The compressor stator of claim 1, and further comprising:

the forward guide vane gap is greater than the rearward guide vane gap.

3. The compressor stator of claim 1, and further comprising:

the spring means comprises a pin movable in a slot, the slot being located in either the outer shroud or the casing, the pin being biased by a spring.

4. The compressor stator of claim 1, and further comprising:

the spring means comprises a cutout forming a finger.

5. The compressor stator of claim 1, and further comprising:

the spring means comprises a C-shaped spring mounted in a slot on the surface of the outer shroud.

6. The compressor stator of claim 1, and further comprising:

the spring means comprises a half-moon shaped spring mounted in a slot on the surface of the outer shroud.

7. The compressor stator of claim 1, and further comprising:

the forward end of the slot is tight fitting with the forward section of the outer shroud and the rearward end of the slot is loose fitting with the rearward section of the outer shroud.

8. The compressor stator of claim 1, and further comprising:

the forward and rearward guide vanes are located at the compressor outlet and upstream from a diffuser.

9. A process for providing a smooth flow of compressed air from a compressor to a diffuser, the compressor having a casing with a circumferential slot to mount a plurality of vane sectors therein, the process comprising the steps of:

providing for a vane sector to have a forward guide vane and a rearward guide vane extending therefrom;

providing for an inner shroud to form a gap between the guide vane tips;

providing for the slot to comprising a space to allow for a rearward portion of the outer shroud to move in a radial direction when the rearward guide vane tip contacts the inner shroud; and, providing for a spring means to bias the rearward portion of the outer shroud toward the inner shroud.

10. The process for providing a smooth flow of compressed air from a compressor to a diffuser of claim 9, and further comprising the step of:

providing for the forward guide vane gap to be larger than the rearward guide vane gap.

11. The process for providing a smooth flow of compressed air from a compressor to a diffuser of claim 9, and further comprising the step of:

providing for the spring means to be a pin biased by a spring in a slot, or a C-shaped spring mounted in a slot of the shroud, or a cutout formed finger on the shroud, or a half-moon shaped spring mounted in a slot of the shroud.

* * * * *